United States Patent [19]

Buchanan

[11] 4,422,829

[45] Dec. 27, 1983

[54] SUMP DRAIN SYSTEM

[76] Inventor: William T. Buchanan, 32 Hamilton La., Oak Brook, Ill. 60521

[21] Appl. No.: 352,361

[22] Filed: Feb. 25, 1982

[51] Int. Cl.[3] ..... F04F 5/48

[52] U.S. Cl. ..... 417/40; 417/89; 417/181

[58] Field of Search ..... 417/36, 38, 40, 87, 417/89, 5, 7, 8, 182, 182.5, 181, 187, 274

[56] References Cited

U.S. PATENT DOCUMENTS 2,763,281 9/1956 Morgan ..... 417/182.5 X 3,963,376 6/1976 Miskin ..... 417/40

3,972,647 8/1976 Niedermeyer ..... 417/40 X 4,060,341 11/1977 Tremain et al. ..... 417/89 X

*Primary Examiner*—Edward K. Look

*Attorney, Agent, or Firm*—Lloyd L. Zickert

[57] ABSTRACT

A drain system for a sump, including an electrically powered sump pump normally operable in response to the water level in the sump to drain the sump when the level reaches a predetermined point, and a water powered pump driven by a source of water under pressure and which operates in the event of an electrical power failure or in the event of a failure of the electrically driven pump.

5 Claims, 2 Drawing Figures

SUMP DRAIN SYSTEM

Figures 1, 2:
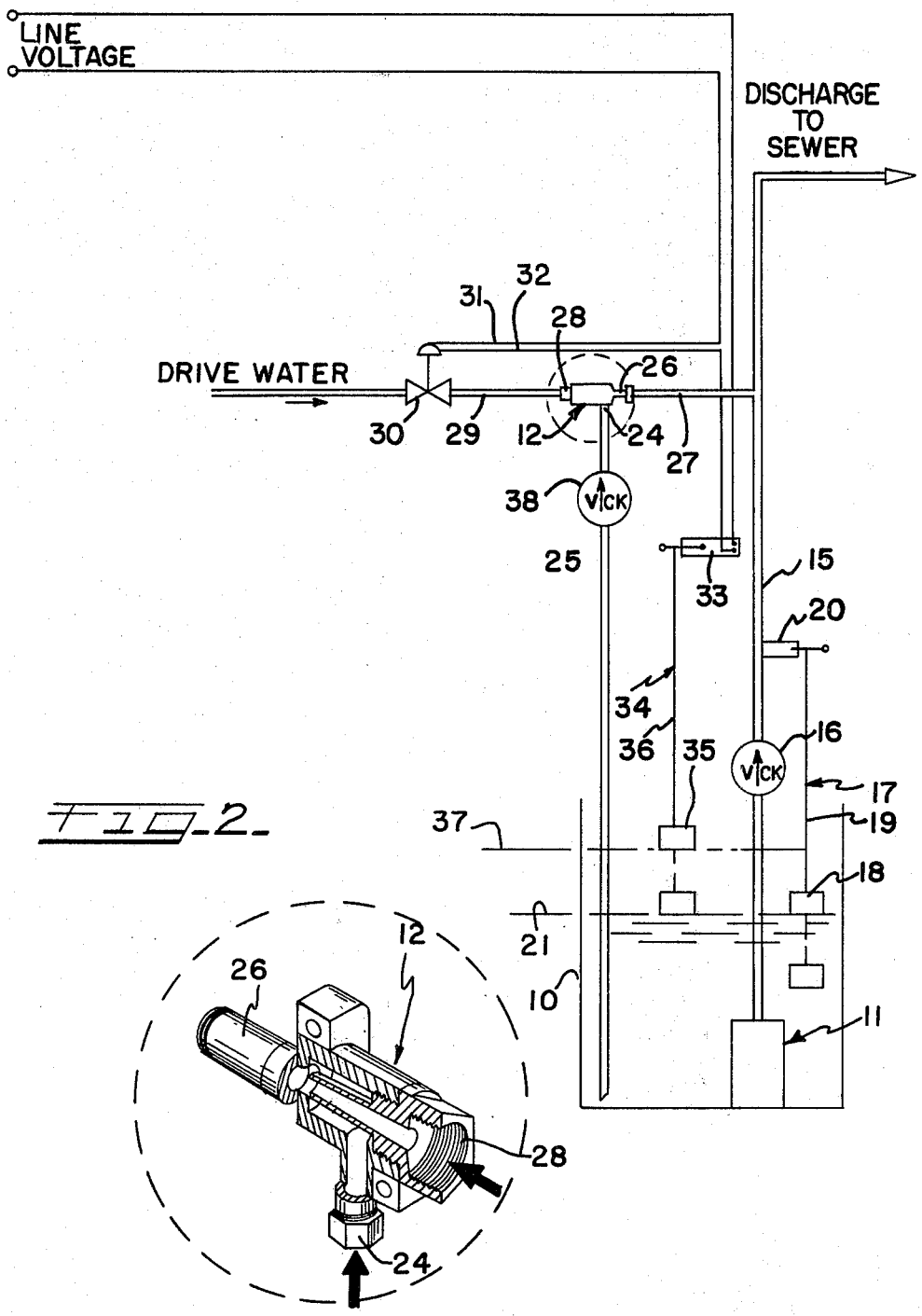

This invention relates in general to a sump drain system for a dwelling where the sump is installed in a basement or the like and for the purpose of preventing basement flooding, and more particularly to a sump drain system which includes an electrically driven pump that normally drains the sump and a water driven pump that operates to drain the sump in the event of an electrical power failure or in the event of failure of the electrically driven pump.

Heretofore, it has been well known to provide sump pumps of various types including electrically operated and water powered pumps. It has also been known to combine in a single sump a water driven pump with an electrically driven pump as disclosed in U.S. Pat. Nos. 3,472,172; 3,963,376 and 4,060,341. Further, it has been well known to combine a line voltage electrically driven sump pump and a battery power driven sump pump as disclosed in U.S. Pat. Nos. 3,726,606; 3,941,507 and 3,972,647.

The heretofore known systems have not always been dependable. Those systems which employ a water driven pump rely generally on a mechanically operated float valve which frequently malfunctions because of deposition of corrosion products, scale and debris. The systems that require auxiliary battery power depend upon maintaining the battery in useful condition and from time to time replacement of the battery due to its limited life.

It is well known that sumps are usually installed in the basement of a house or commercial building where it receives little attention but where it is important to keep operating in order to prevent basement flooding. A sump having only an electrically powered pump driven by line voltage is automatically inoperative during a power failure, and it can also malfunction even when there is no power failure. In either event, basement flooding results. A sump drain system utilizing an auxiliary pump operating on batteries depends upon the battery being in good condition, and even when it is in good condition, it has a limited life if the battery driven pump is operated over a long period of time. As above mentioned, systems having mechanically operated float valves which are capable of sticking may cause a primary pump to become inoperative as well as any auxiliary pump used with the system.

The present invention overcomes the difficulties heretofore encountered in that it will operate during power failures or the failure of a primary sump pump. Additionally, it will operate over a long period of time as it does not depend upon any batteries. Since it does not use any mechanically operating float valves, it is more dependable. More particularly, the system of the present invention includes a regular sump pump operated by the line voltage or house current in response to the level of the water in the sump and a water driven pump of the ejector or eductor type which is well known and which is operable from the water supply to the house or commercial building. It is well known that municipal water supply systems generally depend upon creating water pressure by gravity whereby a power failure will not interrupt the water supply. A normally open electric valve is used to control the water supply to the water driven pump which, when energized, will cut off the flow of water to the pump. Thus, when a power failure occurs, the valve opens to commence operation of the water driven pump. A float operated electrical switch responsive to the water level in the sump is connected in series to the electrical power supplying the water control valve such that in the event of failure of the line voltage driven sump pump, the electrical power to the water control valve is interrupted to allow operation of the water driven pump until the water level in the sump falls below a predetermined level, after which electrical power is restored to the water control valve to cease operation of the water driven pump. While the system of the invention will be generally described as including a conventional sump pump in combination with a water driven sump pump having a unique control system, it should be appreciated the water driven pump and its control system is a subcombination that could be installed with any existing sump having a standard sump pump.

It is therefore an object of the present invention to provide a new and improved sump drain system to prevent basement flooding which automatically operates during power failures and the failure of a regular sump pump.

Another object of the present invention is in the provision of a sump drain system which is capable of operating during power failures over a long period of time since it is not dependent upon batteries to maintain operation.

A further object of the present invention is to provide a drain system for a sump which will operate to drain the sump in the event of a power failure or in the event of failure of the regular sump pump and which does not depend upon any mechanically operated float valves to accomplish the draining function.

A still further object of the present invention is to provide a sump drain system which may easily be installed in any sump which is inexpensive and which prevents basement flooding during power failures or the failure of a main sump pump.

Still another object of the present invention is to provide a sump drain system including a line voltage operated electrical pump and a water driven pump operable from a source of water under pressure, wherein the water driven pump will commerce operation in the event of a power failure or in the event of failure of the line voltage driven pump. Other objects, features and advantages of the invention will be apparent from the following detailed disclosure, taken in conjunction with the accompanying sheets of drawings, wherein like reference numerals refer to like parts, in which:

FIG. 1 is a schematic diagram of the sump drain system of the present invention; and FIG. 2 is a cross-sectional view of the water driven pump utilized in the drain system shown in FIG. 1.

Referring now to the drawings and particularly to FIG. 1, a sump 10 of the usual type which would collect drain water is illustrated as having a sump drain system of the present invention associated therewith for purposes of draining the water from the sump. It will be appreciated that the sump 10 would normally be disposed in the basement of a house or a commercial building or otherwise so as to collect waters from a foundation drain system or from the basement so that the water can be pumped out and into a sewer or onto land which would allow it to drain away from the house or building. The sump drain system of the invention generally includes a line voltage operated sump pump 11 and a water driven sump pump 12. The sump pump 11 could be of the conventional type which would include an electric motor driving a pump and suitably connected to the line voltage or building electric power. However, it should be appreciated that the water driven sump pump 12 could be installed in connection with any existing line voltage driven sump pump for purposes of providing the protection desired against basement flooding.

While not specifically shown, the sump pump 11 would have an intake at the bottom of the sump 10 and would pump the water upwardly through a discharge line 15 to the sewer or to a place where it could run off away from the building. A check valve 16 is provided in the discharge line 15 to allow water to be pumped upwardly and outwardly through the line 15 but not allow it to return back into the sump. A conventional float operated assembly 17 functions to turn the sump pump 11 on and off in response to the level of the water in the sump. This assembly includes a float 18 which moves up and down with the level of the water in the sump, a float rod 19 connected to the upper end of the float and to an electrical switch 20 which, while not shown, is electrically connected between the line voltage and the sump pump 11. This electrical switch would be of the normally open type whereby when the float would reach the level 21, it would close due to the action of the float 18 and movement of the float rod 17 to cause energization of the sump pump to drain the sump. Once the sump is drained to a predetermined level, the downward movement of the float 18 would automatically cause the switch 20 to open and de-energize the pump 11.

The water driven pump 12 is of a standard eductor or ejector type, as shown more particularly in FIG. 2, which includes an inlet or suction line connection 24 connectable to a sump water suction line 25 that extends into the sump and terminates near the bottom of the sump, as shown in FIG. 1. A check valve 38 is mounted in suction line 25 to prevent water from reversing back through suction line 25 from discharge line 15 either by gravity or from the normal operation of sump pump 11. Check valve 38 could optionally be in line 27. The pump 12 also includes a discharge line connection or outlet 26 which is connected to a line section 27 that is in turn connected to the discharge line 15 and through which the pump drive water and sump water are discharged. A drive water inlet connection 28 is connected to a water supply line 29 that would have the usual water under pressure supply for a house or a building and which, in turn, would normally be connected to a municipal water supply, thereby providing water under pressure to operate the ejector pump 12. An electrically operated control valve 30 is mounted in the water supply line 29 and operable to selectively allow the water supply to be fed to the pump 12. Valve 30 is of the normally open type whereby it will only close upon being connected to line voltage. Line voltage conductors 31 and 32 are connected to the line voltage. Additionally, a normally closed switch 33 is connected in series with the power line and electric control valve so that line voltage is maintained with the valve 30 when the switch 33 is closed. Operation of switch 33 is accomplished by a float mechanism 34 which includes a float 35 and a float rod 36. When the float 35 moves to the switch operating sump level 37, switch 33 will be opened to interrupt the power to the control valve 30 and allow water to be supplied to the pump 12 so that it can operate to drain the sump. When the water level falls to a predetermined point thereby causing the float to likewise fall such that switch 33 is again closed, line voltage is again established to stop the water supply to the pump and thereby discontinue pump operation.

The water driven pump 12 is of a conventional ejector or eductor type whereby upon being supplied with the water power at the water power inlet 28 and which drives the water through the ejector, a suction is created at the suction connection 24 which by differential pressure causes the water in the sump to be forced up through the suction line and then out through the discharge of the pump and on to the sewer. It will be appreciated that any suitable type of water driven pump may be provided for accomplishing the sump draining function.

During normal operation of the sump drain system, the sump pump 11 will control the water level in the sump 10 by draining water when the level reaches a predetermined point. In the event of line voltage failure and the lack of being able to provide electrical power to the pump 11, since the electrical control valve 30 is connected to the line voltage and it is necessary to have power at the valve in order to maintain it closed, this valve will open and allow operation of the water driven pump 12 to drain the sump. The pump 12 will continue to operate until line voltage is restored, after which the valve 30 will close and stop the flow of drive water to the pump 12. Should the sump pump fail while the line voltage is still on, the water driven pump will commence operation once the float operated switch 33 detects the level of the water in the sump at a point higher than that which would normally operate the pump 11. After the water level has been drained to a predetermined point, the switch 33 will close and restore power to the valve 30 and cut off the supply of drive water to the pump 12.

From the foregoing, it can be appreciated that the present invention provides a sump drain system that will prevent basement flooding when the power goes out or when the regular electrically driven sump pump fails. It will be recognized that the water driven pump and its controls could be installed with any type of regular sump pump.

It will be understood that modifications and variations may be effected without departing from the scope of the novel concepts of the present invention, but it is understood that this application is to be limited only by the scope of the appended claims.

The invention is hereby claimed as follows:

1. A drain system for a sump disposed in a dwelling supplied with electrical power and municipal water, said system comprising a first pump energizable by said electrical power, and a second pump energizable by said municipal water, first means causing said first pump to be energized and drain the sump in response to the water rising to a first predetermined level, and second means causing said second pump to be energized and drain the sump immediately upon a failure of said electrical power, said second means further causing said second pump to be energized and drain the sump upon the water rising to a second predetermined level higher than said first predetermined level.

2. The drain system of claim 1, wherein said first means includes a float operated switch selectively connecting electric power to said first pump.

3. The drain system of claim 1, wherein said second means includes a normally open electric control valve selectively connecting the municipal water to said second pump, and a float operated normally closed electric switch selectively supplying electrical power to said electric control valve.

4. The drain system of claim 2, wherein said second means includes a normally open electric control valve selectively connecting the municipal water to said second pump, and a float operated normally closed electric switch selectively supplying electrical power to said electric control valve.

5. An automatic drain system for removing water from a sump comprising, first and second pumps connected to said sump to pump water from the sump, said first pump having an electric motor for driving same, a source of electrical power for said motor, and a float operated control for causing the motor to be connected to said source of electrical power when the water in the sump is at a predetermined level, a source of water under pressure, said second pump being operated by said source of water under pressure, an electrically operated control valve for selectively connecting said water source to said second pump, and a float operated switch for selectively connecting said electrical power to said control valve, whereby said control valve is open when de-energized and therefore when the electrical power fails, and said switch is open when the water is at a predetermined level above the level which causes the motor to be connected to said source of electrical power to de-energize and open the control valve.

* * * * *